United States Patent [19]

Latus et al.

[11] 4,055,937

[45] Nov. 1, 1977

[54] DOUBLE TWIST THREAD TWISTING FRAME

[75] Inventors: Hans Latus; Zdenek Hemala, both of Kempten; Heinz Bleeck, Probstried; Rolf Dieter Weber, Kempten, all of Germany

[73] Assignee: Saurer-Allma GmbH Allgaeuer Maschinenbau, Kempten, Germany

[21] Appl. No.: 727,366

[22] Filed: Sept. 27, 1976

[30] Foreign Application Priority Data

Oct. 6, 1975 Germany ..... 7531678

[51] Int. Cl.[2] ..... D01H 1/10; D01H 1/16; D01H 11/00; D01H 13/30

[52] U.S. Cl. ..... 57/34 R; 57/35; 57/56; 57/58.49; 57/108

[58] Field of Search ..... 57/34 R, 56, 58.49, 57/58.83, 108, 106, 35, 164

[56] References Cited

U.S. PATENT DOCUMENTS

| | | | |
|---|---|---|---|
| 3,071,918 | 1/1963 | Hofstetter | 57/56 |
| 3,299,624 | 1/1967 | Nimtz | 57/108 |
| 3,373,552 | 3/1968 | Scherr | 57/56 |
| 3,412,545 | 11/1968 | Lippuner | 57/56 |
| 3,429,113 | 2/1969 | Nimtz et al. | 57/34 R |
| 3,857,228 | 12/1974 | Nakahara et al. | 57/56 |

*Primary Examiner*—John Petrakes
*Attorney, Agent, or Firm*—Blanchard, Flynn, Thiel, Boutell & Tanis

[57] ABSTRACT

A double twist thread twisting frame having a plurality of double twist spindles thereon each of which is surrounded by a balloon limiter having an upper rim thereon and at their lower parts a storage disc and a whorl driven by a belt spaced below the storage disc. A closure structure is provided around each balloon limiter to define a channel which communicates with the spindles and the interior of the balloon limiters. A suction device is connected in circuit with the channel means to evacuate the air contained therein. The closure structure, particularly an upper wall thereof, is located generally at the level of the upper rim of the balloon limiter and has a circular opening coaxial with the upper rim of the balloon limiter. The circular opening is somewhat smaller in diameter than the upper part of the balloon limiter. A suction opening is provided in the balloon limiter below the upper wall of the closure structure and a blower nozzle is connected to a tube which extends in the longitudinal direction of the frame for supplying conditioned air to the circular opening in the balloon limiter.

10 Claims, 4 Drawing Figures

DOUBLE TWIST THREAD TWISTING FRAME

FIELD OF THE INVENTION

The invention relates to a double twist thread twisting frame having a plurality of double twist thread twisting spindles each of which is surrounded by a balloon limiter and has at its lower part a storage disc and beneath this a whorl driven by a belt, there being provided above and below the balloon limiter a closure wall extending over the whole width and length of the frame and, on both long sides of the frame, side walls arranged externally of the balloon limiter and connected to the upper and lower closure walls, the channel enclosed by these walls communicating with the spindles and the balloon limiters and being connected to a suction device.

BACKGROUND OF THE INVENTION

In such double twist frame which is known (from German Auslegeschrift 2 130 621) the upper closure wall is arranged above the balloon thread guide and the lower closure wall is arranged below the whorl and the driving belt. The side walls extend from the lower to the upper closure wall and thus completely enclose the spindles. For the performance of servicing work at least a part of the side wall associated with each spindle is adjustable. The closure walls and side walls consist of sound reflecting and/or sound absorbing material. In this manner there is obtained, in the first place, protection of the attendant personnel against noise. At the same time however the channel enclosed by the closure walls and side walls is connected to a suction device. Thereby, fly occurring from the twisting is sucked away and soiling of the frame is prevented.

Owing to the complete encapsuling of the double twist thread twisting spindles a plurality of flaps associated with each spindle are necessary in order that servicing work such as threading, removing broken threads and so on may be performed at the spindle. This plurality of flaps and rotatable casing parts however increases the cost of the frame considerably and also makes impossible the use of an automatic service carriage for performing the work of threading, removal of broken threads and the presentation of the thread. Moreover, in the case of this known double twist frame conditioning, viz. moistening of the thread is possible only by conditioning the whole of the space in which the frame is located. Moistening of the thread favours the twisting operation and reduces the formation of fly.

It is known (from German Offenlegungsschrift 2,356,562) to feed conditioned air to supply bobbin by means of a blower nozzle directed towards the spindle. Beneath the storage disc of the spindle, in this known device, there is arranged a suction nozzle for sucking away the fly. However, this suction nozzle can only collect fly that reaches its direct vicinity. It has been established that the air is heated relatively strongly by the heat produced in the region of the spindle drive. This heated air then rises in the balloon limiter as in a chimney. There results a strong upward current of air, assisted by the rotation of the spindle and the balloon of thread in the balloon limiter, by which the fly is conveyed upwardly away from the suction nozzle. Moreover, owing to the friction of the thread on the inner wall of the balloon limiter, further fly results which is not gathered by the suction nozzle.

The invention is based on the problem of providing a double twist thread twisting frame of the type mentioned initially, which whilst avoiding the above-mentioned disadvantages is simpler in construction and in which the spindles are accessible from above, so that an automatic service carriage can be used, and in which the fly is removed to a large extent and which also permits direct conditioning of the material being supplied.

In accordance with the invention this is achieved in that the upper closure wall is arranged approximately at the level of the upper rim of the balloon limiter and in the region of each balloon limiter has a circular opening coaxial therewith, that the upper rim of the balloon limiter and/or the circular opening is somewhat smaller in diameter than the part of the balloon limiter located beneath it, and there is provided on the balloon limiter in the region beneath the upper closure wall a suction opening connected to the internal space of the channel, and that above each balloon limiter there is provided a blower tube known in itself directed towards the spindle and connected to a pipe extending in the longitudinal direction of the frame, by which nozzle conditioned air is fed to the supply bobbin.

By arrangement of the upper closure wall at the level of the upper rim of the balloow limiter the spindle is freely accessible from above. In this way flaps and other cladding parts become unnecessary, so that the frame is of simpler construction. Moreover, the free access permits the use of an automatic service carriage. At the same time owing to this construction blower nozzles may also be used which blow the conditioned air directly in the direction of the supply bobbin. In this way conditioning of the whole frame shop can be avoided and also the material being supplied does not need to be previously conditioned in a special conditioning space. The intensive conditioning of the supply material also has the advantage that the formation of fly is reduced. At the same time, with the novel double twist frame very good removal of fly is achieved. Since the twisting spindle is completely surrounded, in the region of the lower rim of the balloon limiter and also of the storage disc, by the channel formed by the upper and lower closure walls and the side walls, an initial sucking away of the fly takes place there. Fly that is carried along by the upwardly directed air current in the balloon limiter and which is present in the balloon limiter itself is to a considerable extent thrown outwardly to the wall of the balloon limiter by the rotating thread. Since the upper rim of the balloon limiter or the circular opening is smaller in diameter than the parts of the balloon limiter located beneath it, and since moreover there is provided in the upper region of the balloon limiter beneath the upper closure wall a suction opening in communication with the internal space of the channel, the fly is to a large extent sucked away through this suction opening. Furthermore, the heat generated continuously at the spindle bearing and at the whorl is removed by the sucking away of the air surrounding these parts. This avoids the effect that the heated air in the balloon limiter rises upwardly, carries fly with it and also dries out the previously moistened thread. In this manner only a very small quantity of fly occurs in the balloon limiter itself, and can at once be removed owing to the above-mentioned design and the suction at the upper rim of the balloon limiter.

Advantageously, the lower closure wall is arranged tightly between the storage disc and the whorl. In this manner the air heated at the whorl is kept away from the other spindles.

In order that the spindle may also be serviced in the region of its storage disc, or be accessible at that place for the corresponding servicing parts of a service carriage, flaps are preferably provided in the side wall beneath the balloon limiter in the region of the storage disc. These flaps are advantageously pivoted at their lower edges and tiltable inwardly. They may extend over a plurality of spindles.

BRIEF DESCRIPTION OF THE DRAWINGS

The invention is explained below in more detail with reference to practical examples illustrated in the drawings.

DETAILED DESCRIPTION

Figure 1:
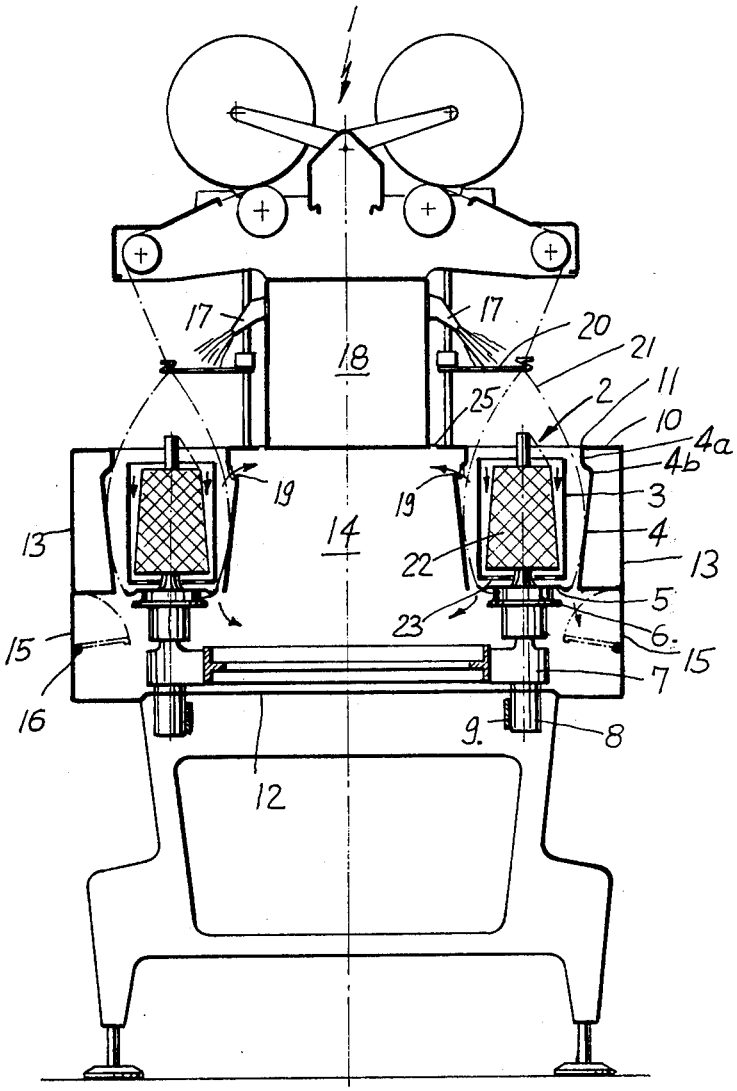
FIG. 1 is a cross-section through the double twist thread twisting frame according to the invention.

In the drawings, there is indicated at 1 the whole of the double twist thread twisting frame, which includes a plurality of double twist spindles 2 arranged in succession in the longitudinal direction of the frame. Each of these spindles has a bobbin box 3 secured against rotation by the force of permanent magnets, and a balloon limiter 4 surrounding the bobbin box. Adjoining the bobbin box and below it is provided a twist plate 5 and below this a storage disc 6. The spindle is rotatably journalled in the bearing 7 and has at its lower and a whorl 8 which is driven by a driving belt 9. Above each spindle is provided a balloon thread guide 20.

At the level of the upper rim of the balloon limiter 4 is provided an upper closure wall 10, which extends over the whole length and width of the frame. The closure wall may of course be composed of several parts. In the region of each balloon limiter 4 it has a coaxial circular opening 11. At the lower end of the spindles is provided a lower closure wall 12 which is located either beneath the spindles or, as is advantageous and as is the case in the example illustrated, between the whorl 8 and the storage disc 6. The two closure walls 11 and 12 are connected together by vertically extending side walls 13. They thus enclose a channel 14, which is open towards the storage disc 6 and the lower end of the balloon limiter 4. This channel 14 is connected to a suction device, so that sub-pressure always obtains in this channel. In the side walls 13 are provided, beneath the balloon limiter 4 and in the region of the storage disc 6, flaps 15 which are pivotal at their lower edges by means of hinges 16 and can tilt inwardly.

Above each balloon limiter 4 is provided for each spindle a blower nozzle 17 directed towards the spindle, the nozzle 17 being connected to a pipe 18 that extends in the longitudinal direction of the frame. Through this pipe 18 conditioned, in particular moistened, air is fed to the blower nozzles 17.

Figure 2:
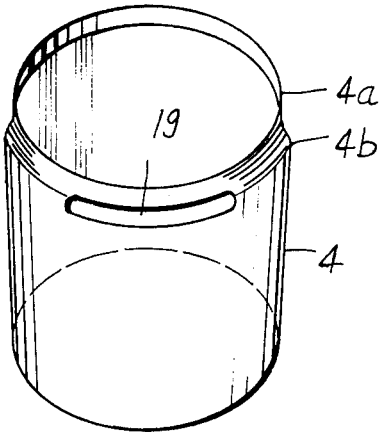
FIG. 2 is a diagrammatic illustration of a balloon limiter used in this twisting frame.

In the practical example illustrated in FIGS. 1 and 2 the balloon limiter widens upwardly in conical form. In its upper region it has a part **4*a* of reduced diameter which is smaller in diameter than the widening 4*b* located beneath it. In the region of the widening 4*b* is provided a suction opening 19, which is in communication with the channel 14. The diameter of the circular opening 11 is such that the upper closure wall 10 abuts tightly against the narrowed part 4*a* of the balloon limiter 4.**

The blower nozzles 17 are advantageously arranged above the balloon thread guide 20 and inclined downwardly towards the thread balloon, so that as far as possible a downwardly directed air current results.

Through the blower nozzles 17 conditioned air of high moisture content is blown into the upper part of the thread balloon 21. Owing to the fanning action of the twist plate 5 there obtains in the bobbin box 3 and also within the thread balloon 21 a minimum sub-pressure, which however suffices to suck the conditioned air. The air passes through the annular gap between the bobbin box and the supply bobbin 22 into the region of the twist plate 5. It can pass through openings 23 which are provided in the base of the bobbin box. The supply bobbin 22 always has moist air flowing over it and is therefore kept moist for treatment. The downwardly directed current of conditioned air is assisted by the sucking action of the channel 14. Since the balloon limiter 4 is in communication with this channel at its upper rim and also the storage disc 6 is arranged in the channel, fly that occurs in the bobbin box and on the storage disc is completely sucked away. Moreover, suction of the air under the spindle heated by the drive and the mounting is drawn off. Likewise a part of the conditioned air sucked through the twist plate 5 above the supply bobbin 22 is sucked away. This prevents heated air from passing into the region of the thread balloon between the balloon limiters 4 and the bobbin boxes 3. It cannot therefore dry out the thread in the region of the thread balloon. By moistening the supply bobbin and avoiding drying out of the thread in the region of the balloon by heated air, the formation of fly that results from friction of the thread on the internal wall of the balloon limiter is greatly reduced. The fly that nevertheless forms in the balloon limiter is conveyed upwardly in a rotating spiral by the rotation of the thread. Owing to the conical shape of the balloon limiter 4 and the adjoining narrowing in the part **4*a* the fly accumulates in the widened part 4*b*. Here it can very easily be sucked through the suction opening 19,** seeing that it is thrown outwardly by the centrifugal force created by the thread balloon. An elongate suction opening is sufficient here since the fly is kept in rotation by the thread.

Figure 4:
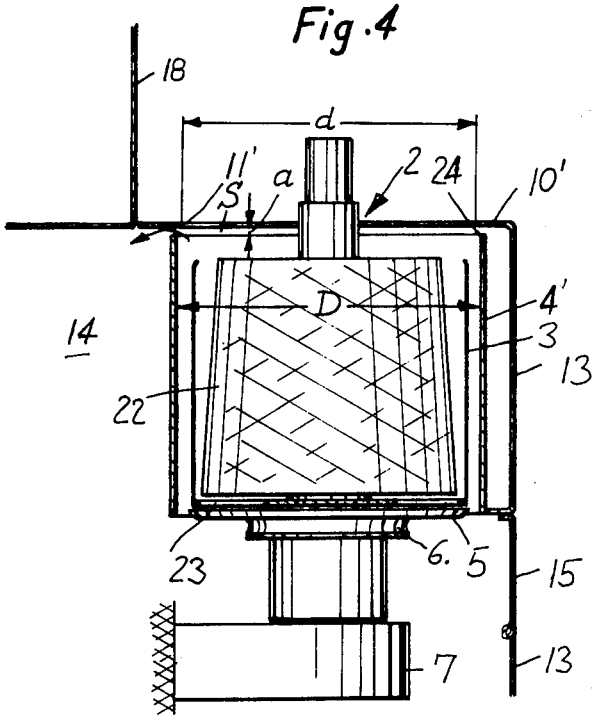
FIG. 4 is a cross-section through this practical example.
Figure 3:
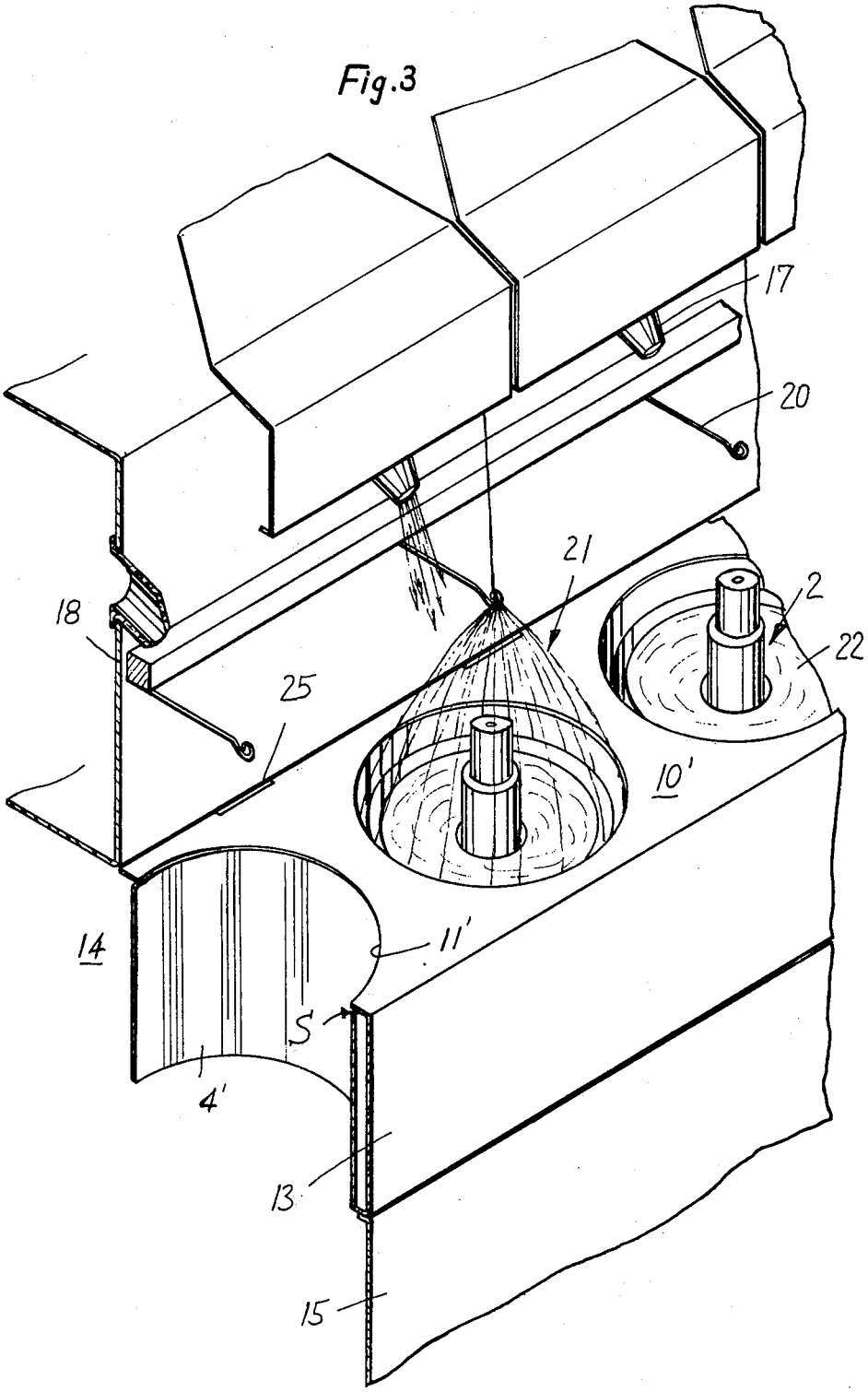
FIG. 3 is a diagrammatic illustration of a second practical example.

The practical example illustrated in FIGS. 3 and 4 is of substantially the same construction, hence description of the parts that are the same will not be given. The only difference is the construction of the balloon limiter 4' and the arrangement of the upper closure wall 10'. In the practical example illustrated in FIGS. 3 and 4 the balloon limiter 4' is cylindrical. The diameter d of the circular opening 11' is somewhat smaller than the diameter D of the balloon limiter. The upper closure wall 10' is arranged at a short distance *a* from the upper rim 24 of the balloon limiter 4'. In this manner, there is formed between the closure wall 10' and the upper rim 24 an annular gap S which is in communication with the suction duct 14 and therefore forms a suction opening. Since the circular opening 11' is of somewhat smaller diameter than the balloon limiter it forms a restriction at which particles of fly can accumulate and hence can be more easily sucked through the annular gap S. This likewise ensures that fly is to a great extent sucked away before the thread emerges from the balloon limiter 4'.

Since however the formation of fly can never quite be avoided on other frame parts that are provided above the balloon limiter, it may happen that fly is deposited on the upper closure wall 10', and especially in the corner region between the upper closure wall 10' and the adjoining conditioning tube 18. In order to remove this fly it is desirable to provide in the corner region between the upper closure wall 10' and the pipe 18 arranged over it suction openings 25 between the spindles, as is illustrated in FIG. 3.

The embodiments of the invention in which an exclusive property or privilege is claimed are defined as follows:

1. In a double twist thread twisting frame having a plurality of double twist spindles each of which is surrounded by a balloon limiter having an upper rim thereon and has at its lower part a storage disc and a whorl driven by a belt spaced below said storage disc, upper and lower closure wall means above and below, respectively, said balloon limiter and extending over the whole width and length of said frame, and on both sides of said frame, side wall means are arranged outside said balloon limiter and connected to said upper and lower closure wall means, channel means defined by said upper, lower and side wall means being in communication with said double twist spindles and the interior of said balloon limiters and having a suction device connected thereto, the improvement comprising wherein said upper closure wall means is arranged generally at the level of said upper rim of said balloon limiter and has in the region of each balloon limiter a coaxial circular opening therein, the diameter of said circular opening being somewhat smaller than the part of the balloon limiter located therebeneath, and wherein there is provided on said balloon limiter in the region below said upper closure wall means a suction opening communicating with said channel means, and wherein above each balloon limiter there is provided blower nozzle means connected to a tube that extends in the longitudinal direction of the frame for supplying conditioned air to said circular opening in said balloon limiter.

2. The improved double twist thread twisting frame according to claim 1, wherein said lower closure wall means is arranged tightly between said storage disc and said whorl.

3. The improved double twist thread twisting frame according to claim 1, wherein said side wall means includes flaps located below said balloon limiter in the region of said storage disc.

4. The improved double twist thread twisting frame according to claim 3, wherein said flaps are supported pivotally at their lower edges and are tiltable inwardly into said channel means.

5. The improved double twist thread twisting frame according to claim 1, wherein said balloon limiter widens conically upwardly from the bottom thereof and in its upper region has a part which is narrowed compared to the widening located under it to define said rim, said suction opening being provided in the region of largest diameter thereof.

6. The improved double twist thread twisting frame according to claim 1, wherein said upper closure wall means is arranged at a short distance (a) from said upper rim of said balloon limiter and wherein said circular openings therein are somewhat smaller in diameter than said rim on said balloon limiter, an annular gap (S) between said rim of said balloon limiter and said upper closure wall means defining said suction opening.

7. The improved double twist thread twisting frame according to claim 1, wherein said lower closure wall means is arranged beneath a frame carrying said spindles and above said whorl.

8. The improved double twist thread twisting frame according to claim 1, wherein in the corner region between said upper closure wall means and said tube arranged above it suction openings are provided between said spindles.

9. The improved double twist thread twisting frame according to claim 1, including a balloon thread guide and wherein said blower nozzle means are arranged above said balloon thread guide and are inclined downwardly towards said circular opening.

10. The improved double twist thread twisting frame according to claim 1, including a bobbin box mounted inside said balloon limiter and wherein said bobbin box has openings therein communicating with said channel means.

* * * * *